US009348265B2

(12) United States Patent
Miyamoto et al.

(10) Patent No.: US 9,348,265 B2
(45) Date of Patent: May 24, 2016

(54) IMAGE FORMING APPARATUS USING AT LEAST ONE SCREEN TO FORM A TONER IMAGE

(71) Applicant: FUJI XEROX CO., LTD., Tokyo (JP)

(72) Inventors: Yoko Miyamoto, Kanagawa (JP); Sho Watanabe, Kanagawa (JP); Masaaki Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 77 days.

(21) Appl. No.: 14/189,463

(22) Filed: Feb. 25, 2014

(65) Prior Publication Data

US 2015/0022828 A1 Jan. 22, 2015

(30) Foreign Application Priority Data

Jul. 17, 2013 (JP) ..... 2013-148819

(51) Int. Cl.
*G03G 15/14* (2006.01)
*G03G 15/00* (2006.01)

(52) U.S. Cl.
CPC ..... *G03G 15/14* (2013.01); *G03G 15/5058* (2013.01); *G03G 2215/0129* (2013.01); *G03G 2215/0164* (2013.01)

(58) Field of Classification Search
None
See application file for complete search history.

(56) References Cited

U.S. PATENT DOCUMENTS

| | | | | |
|---|---|---|---|---|
| 6,133,927 | A | 10/2000 | Arai et al. | |
| 6,636,708 | B2 * | 10/2003 | Takahashi | 399/66 |
| 2002/0085249 | A1 * | 7/2002 | Tsuda et al. | 358/515 |
| 2004/0008383 | A1 * | 1/2004 | Klein et al. | 358/3.06 |
| 2007/0242980 | A1 * | 10/2007 | Kikuchi et al. | 399/167 |
| 2008/0278739 | A1 * | 11/2008 | Kudo | 358/1.14 |
| 2009/0232539 | A1 * | 9/2009 | Nozawa et al. | 399/101 |
| 2010/0158568 | A1 * | 6/2010 | Yasumoto | 399/165 |

FOREIGN PATENT DOCUMENTS

| | | |
|---|---|---|
| JP | A-11-198451 | 7/1999 |
| JP | A-2001-45306 | 2/2001 |
| JP | A-2006-184476 | 7/2006 |

* cited by examiner

*Primary Examiner* — Ming Hon
(74) *Attorney, Agent, or Firm* — Oliff PLC

(57) ABSTRACT

An image forming apparatus includes an image forming portion that forms a toner image using a screen; a first transfer member that transfers the toner image formed by the image forming portion to a rotating transfer belt; a second transfer member that transfers the toner image transferred to the transfer belt by the first transfer member to a recording medium; and a controller that differentiates between, in a transfer area of the transfer belt to which the toner image is transferred by the first transfer member a screen that is used to form a toner image to be transferred to the transfer area in a preceding print cycle and a screen that is used to form a toner image to be transferred to this transfer area for the first time after the transfer belt has been rotated and the toner image has been second-transferred to a recording medium.

9 Claims, 12 Drawing Sheets

IMAGE FORMING APPARATUS USING AT LEAST ONE SCREEN TO FORM A TONER IMAGE

CROSS-REFERENCE TO RELATED APPLICATIONS

This application is based on and claims priority under 35 USC 119 from Japanese Patent Application No. 2013-148319 filed Jul. 17, 2013.

BACKGROUND

Technical Field

The present invention relates to image forcing apparatuses.

SUMMARY

According to an aspect of the invention, there is provided an image forming apparatus including; an image forming portion that forms a toner image using a screen; a first transfer member that transfers the toner image formed by the image forming portion to a rotating transfer belt; a second transfer member that transfers the toner image transferred to the transfer belt by the first transfer member to a recording medium; and a controller that differentiates between, in a transfer area of the transfer belt to which the toner image is transferred by the first transfer member, a screen that is used to form a toner image to be transferred to the transfer area in a preceding print cycle and a screen that is used to form a toner image to be transferred to this transfer area for the first time after the transfer belt has been rotated, and the toner image has been second-transferred to a recording medium.

With the image forming apparatus according to the above aspect of the present invention, it is possible to suppress the variation in color intensity doe to a charging record remaining in the transfer belt, compared with a case where a screen that is used to form a toner image to be transferred to a transfer area in a preceding print cycle and a screen that is used to form a toner image to be transferred to this transfer area in the subsequent print cycle are the same.

BRIEF DESCRIPTION OF THE DRAWINGS

Exemplary embodiments of the present invention will be described, in detail based on the following figures, wherein.

DETAILED DESCRIPTION

First Exemplary Embodiment

An exemplary image forming apparatus according to a first exemplary embodiment of the present invention will be described, below with reference to FIGS. 1 to 10. The arrows H and W in some drawings respectively indicate the vertical direction, i.e., the top-bottom direction of the apparatus, and the horizontal direction, i.e., the width direction of the apparatus.

Overall Configuration of Image Forming Apparatus

Figure 10:
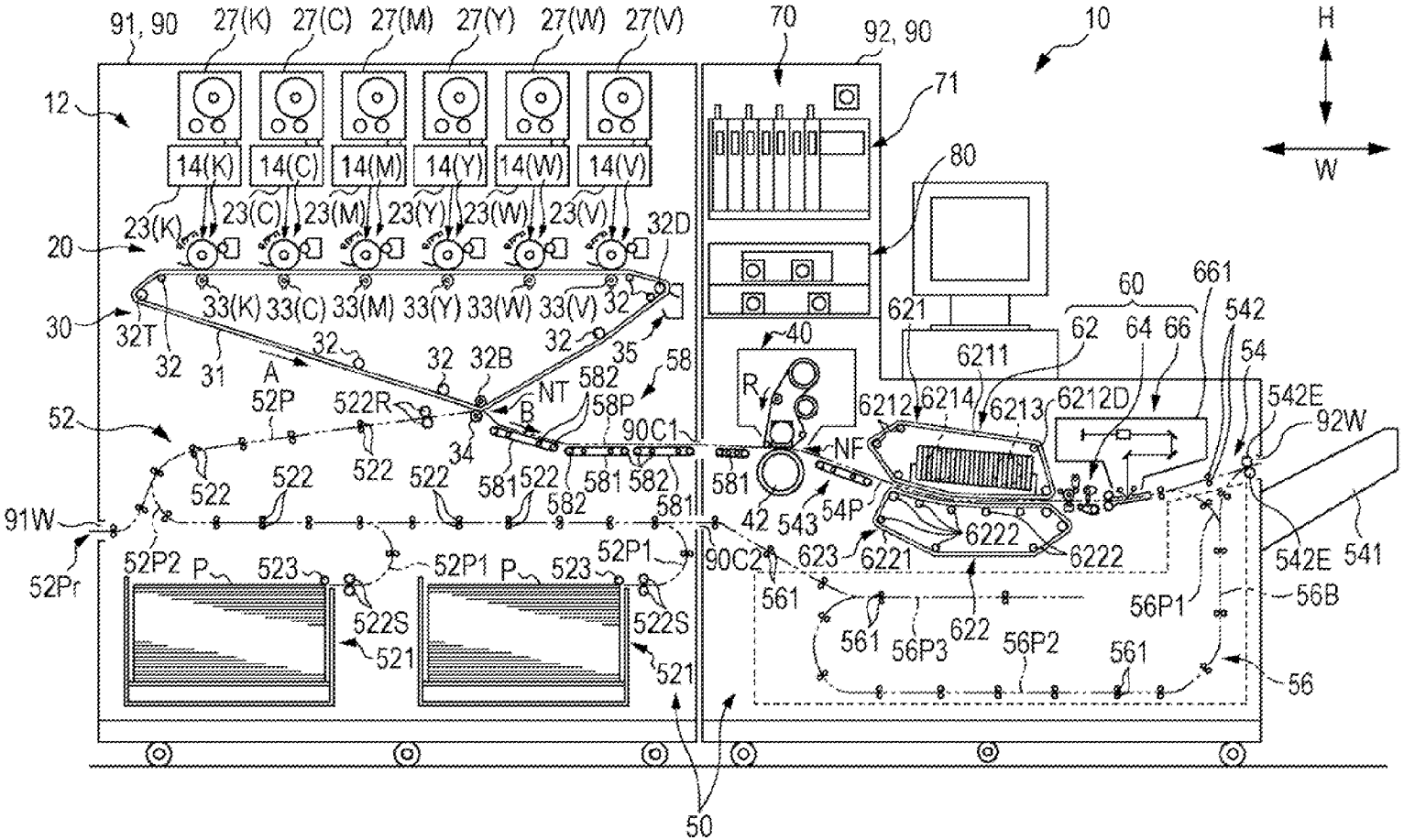
FIG. 10 is a schematic diagram showing the configuration of the image forming apparatus according to the first exemplary embodiment of the present invention.

FIG. 10 is a schematic diagram showing the overall configuration of an image forming apparatus 10, as viewed from the front. As illustrated in FIG. 10, the image forming apparatus 10 includes an image forming section 12 in which an image is formed on a sheet member P, serving as a recording medium, by an electrophotographic system; a medium transport device 50 that transports the sheet member P; and a postprocessing section 60 that performs postprocessing on the sheet member P having the image formed thereon.

The image forming apparatus 10 further includes a controller 70 that controls the aforementioned units and a power supply unit 80 described below, and the power supply unit 80 that supplies power to the aforementioned units including the controller 70.

The image forming section 12 includes toner-image forming portions 20 (an example of an image forming portion) that form toner images, a transfer device 30 that transfers the toner images formed by the toner-image forming portions 20 to a sheet member P, and a fixing device 40 that fixes the toner images transferred to the sheet member P onto the sheet member P.

The medium transport device 50 includes a medium feeding portion 52 that feeds a sheet member P to the image forming section 12, and a medium discharge portion 54 that discharges the sheet member P having a toner image formed thereon. The medium transport device 50 further includes a medium returning portion 56 that is used when an image is formed on each side of the sheet member P, and an intermediate transport portion 58 (described below).

The postprocessing section 60 includes a medium cooling portion 62 that cools a sheet member P having a toner image transferred thereto in the image forming section 12, a straightening device 64 that straightens the curled sheet member P, and an image inspection portion 66 that inspects the image formed on the sheet member P. The components constituting the postprocessing section 60 are disposed in the medium discharge portion 54 of the medium transport device 50.

The components of the image forming apparatus 10 are accommodated in a housing 90, except for a discharged-medium receiving portion 541, which constitutes the medium discharge portion 54 of the medium transport device 50. The housing 90 according to this exemplary embodiment has a two-segment structure including a first housing 91 and a second housing 92 arranged side-by-side in the width direction of the apparatus. This structure reduces the unit of transportation of the image forming apparatus 10 in the width direction of the apparatus.

The first housing 91 accommodates principal components of the image forming section 12 excluding the fixing device 40 (described below), and the medium feeding portion 52. The second housing 92 accommodates the fixing device 40 constituting the image forming section 12; the medium discharge portion 54 excluding the discharged-medium receiving portion 541; the medium cooling portion 62; the image inspection portion 66; the medium returning portion 56; the controller 70; and the power supply unit 80. The first housing 91 and the second housing 92 are coupled with fastening members, such as bolts and nuts (not shown). In this joined state, a communication opening 90C1, through which, the sheet member P is transported from a transfer nip NT (described below) of the image forming section 12 to a fixing nip NF, and a communication path 90C2 along which the sheet member P is transported from the medium returning portion 56 to the medium feeding portion 52, are formed between the first housing 91 and the second housing 92.

Image Forming Section

Figure 9:
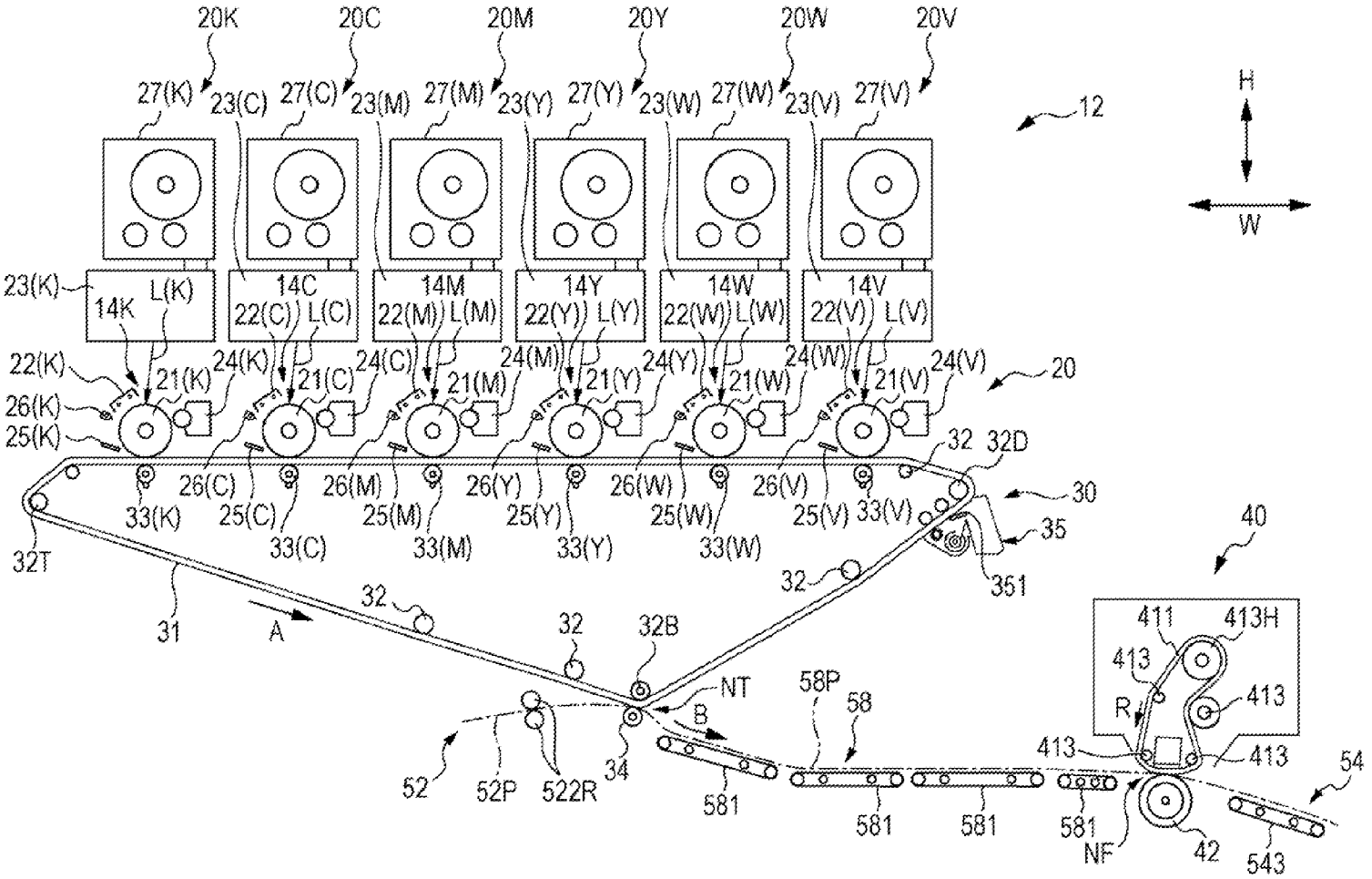
FIG. 9 is a diagram showing the configuration of the image forming portions, a fixing device, etc. of the image forming apparatus according to the first exemplary embodiment of the present invention.

As has been described above, the image forming section 12 includes the toner-image forming portions 20, the transfer device 30, and the fixing device 40. There are multiple toner-image forming portions 20 so that different color toner images are formed. In this exemplary embodiment, the toner-image forming portions 20 corresponding to six colors, in total, including a first special color (V), a second special color (W), yellow (Y), magenta (M), cyan (C), and black (K) are provided. The letters (V), (W), (Y), (M), (C), and (K) shown in FIG. 9 represent these colors. The transfer device 30 transfers six colors of toner images, which have been transferred to the transfer belt 31 in a superposed manner (first transfer), from the transfer belt 31 to a sheet member P at the transfer nip NT.

In this exemplary embodiment, the first special color (V) and the second special color (W) are, for example, a first corporate color and a second corporate color that are specific to a user and are more frequently used than the other colors.

Toner-Image Forming Portion

Figure 8:
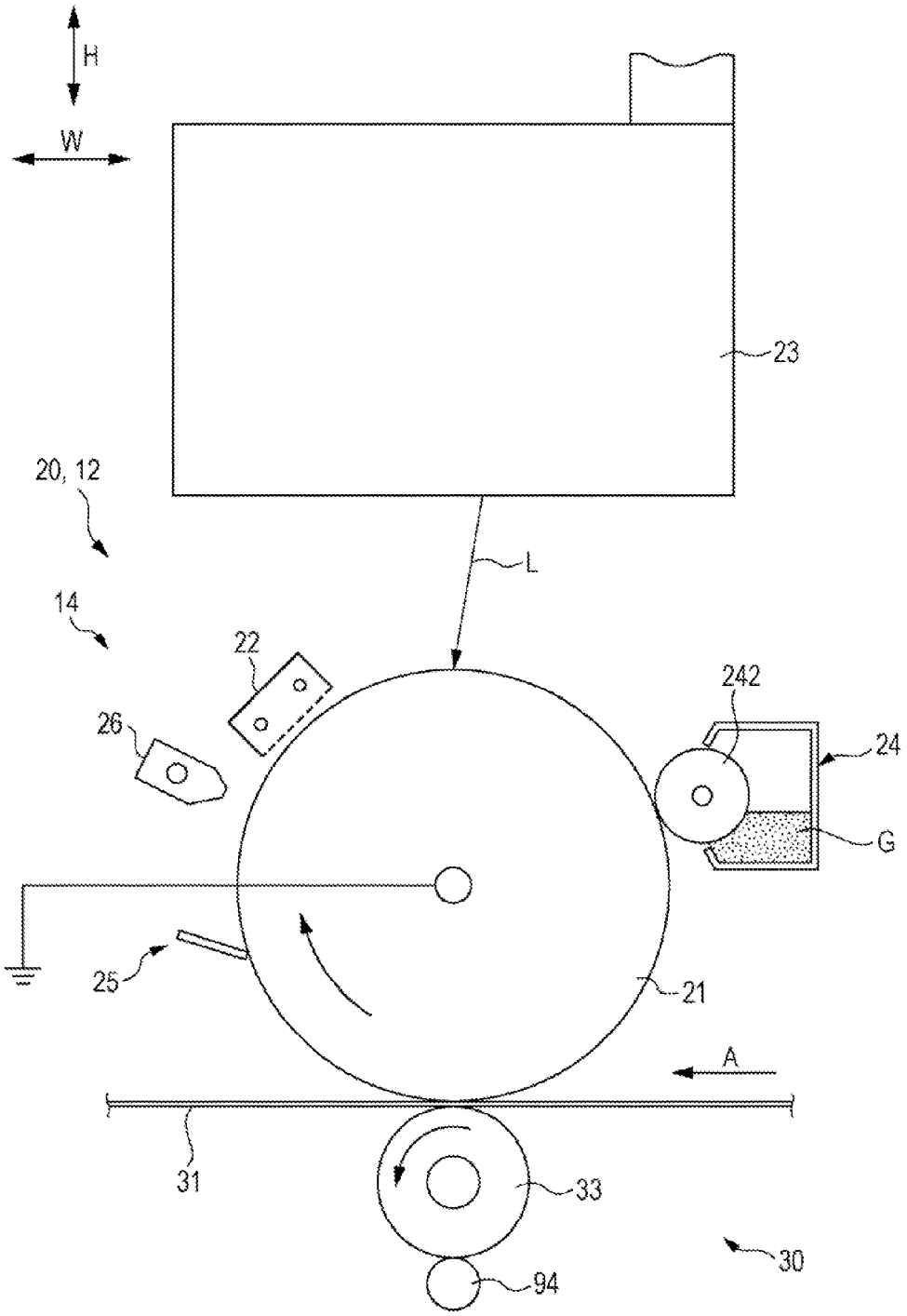
FIG. 8 is a diagram showing the configuration of a photoconductor drum etc. of the image forming apparatus according to the first exemplary embodiment of the present invention.

The toner-image forming portions 20 corresponding to the respective colors have basically the same configuration except for the toner they use. Hence, in the following description, the image forming units 14 corresponding to the respective colors are not specifically distinguished from one another. As illustrated in FIG. 8, the image forming unit 14 of each toner-image forming portion 20 includes a photoconductor drum 21, which is an example of an image-bearing member; a charger 22; an exposure device 23; a developing device 24, which is an example of a developing unit; a cleaner 25; and a static electricity eliminator 26.

Photoconductor Drum

The photoconductor drum 21 is formed in a cylindrical shape, is grounded, and is rotated about its own shaft by a driving unit (not shown). The photoconductor drum 21 has, for example, a negatively charged photosensitive layer on the surface. As illustrated is FIG. 9, the photoconductor drums 21 corresponding to the respective colors are arranged in a straight line in the width direction of the apparatus, as viewed from the front.

Charger

As illustrated in FIG. 8, the charger 22 negatively charges the surface (photosensitive layer) of the photoconductor drum 21. In this exemplary embodiment, the charger 22 is a scorotron charger of a corona discharging type (non-contact charging type).

Exposure Device

The exposure device 23 forms an electrostatic latent image on the surface of the photoconductor drum 21. More specifically, an image-signal processing unit 71 (see FIG. 10) constituting the controller 70 generates gradation data from image data received from an external device, and the exposure device 23 radiates exposure light L, modulated according to the gradation data, to the surface of the photoconductor drum 21 charged by the charger 22. Due to the radiation of the exposure light L by the exposure device 23, an electrostatic latent image is formed on the surface of the photoconductor drum 21.

Developing Device

The developing device 24 develops the electrostatic latent image formed on the surface of the photoconductor drum 21 with developer G containing negatively charged toner, thereby forming a toner image on the surface of the photoconductor drum 21.

The developing device 24 receives a supply of the toner from a toner cartridge 27 containing the toner.

Cleaner

The cleaner 25 is a blade-shaped member that scrapes off the toner remaining on the surface of the photoconductor drum 21 from the surface of the photoconductor drum 21 after the toner image has been transferred to the transfer device 30.

Static Electricity Eliminator

The static electricity eliminator 26 eliminates static electricity by radiating light to the photoconductor drum 21 after the transfer. By doing so, the charging record of the surface of the photoconductor drum 21 is deleted.

Transfer Device

The transfer device 30 transfers (first transfer) the toner images on the photoconductor arums 21 corresponding to the respective colors to the transfer belt 31 in a superposed manner and then transfers (second transfer) the superposed toner image to the sheet member P. A detailed description will be given below.

Transfer Belt

As illustrated in FIG. 9, the transfer belt 31 is configured as an endless loop and is wound around multiple rollers 32, forming a certain shape. In this exemplary embodiment, the transfer belt 31 has an inverted obtuse triangular shape elongated in the width direction of the apparatus, as viewed from the front. Among the rollers 32, a roller 32D illustrated in FIG. 9 functions as a driving roller that drives the transfer belt 31 in the arrow A direction by the motive power provided by a motor (not shown).

Furthermore, among the rollers 32, a roller 327 illustrated in FIG. 9 functions as a tension roller that applies tension to the transfer belt 31. Among the rollers 32, a roller 32B illustrated in FIG. 9 functions as an opposing roller provided opposite the second transfer roller 34 (described below). An obtuse lower apex portion of the transfer belt 31, which is stretched in an inverted obtuse triangular shape as described above, is wound around the roller 32B. The transfer belt 31 is in contact with the photoconductor drums 21 corresponding to the respective colors from below, at the upper side extending in the width direction of the apparatus in the above-described shape.

First Transfer Roller

First transfer rollers 33 (an example of a first transfer member), which are an example of a transfer member and transfer the toner images on the photoconductor drums 21 to the transfer belt 31, are arranged inside the transfer belt 31. The first transfer rollers 33 are arranged opposite the corresponding photoconductor drums 21 with the transfer belt 31 therebetween. A transfer voltage (or transfer current) having a pole opposite to the pole of the toner is supplied to the first transfer rollers 33. As a result, the toner images formed on the photoconductor drums 21 are transferred to the transfer belt 31.

Second Transfer Roller

Furthermore, the transfer device 30 includes the second transfer roller 34 (an example of a second transfer member) that transfers the superposed toner image on the transfer belt 31 to the sheet member P. The second transfer roller 34 is disposed so as to nip the transfer belt 31 with respect to the roller 32B, forming the transfer nip NT with respect to the transfer belt 31. A sheet member P is fed to this transfer nip NT at an appropriate time from the medium feeding portion 52. The core of the second transfer roller 34 is grounded, and a transfer voltage (or transfer current) having a pole the same as the pole of the toner is applied to the roller 32B by a power feeding unit (not shown). As a result, the toner image is transferred from the transfer belt 31 to the sheet member P passing through the transfer nip NT.

Cleaner

The transfer device 30 further includes a cleaner 35 that cleans the transfer belt 31 after the second transfer. The cleaner 35 is disposed on the downstream side of the portion where the second transfer is performed (i.e., the transfer nip NT) and on the upstream side of the portion where the first transfer is performed, in the rotation direction of the transfer belt 31. The cleaner 35 has a blade 351 that scrapes off the toner remaining on the surface of the transfer belt 31 from the surface of the transfer belt 31.

Outline of Fixing Device

The fixing device 40 fixes a toner image transferred to a sheet member P by the transfer device 30 to the sheet member P. In this exemplary embodiment, the fixing device 40 is configured to fix the toner image to the sheet member P by heating and applying pressure to the toner image at the fixing nip NF formed between a pressure roller 42 and a fixing belt 411 wound around multiple rollers 413. A roller 413H is a heating roller that has, for example, a built-in heater and is rotated by a driving force transmitted from a motor (not shown). Thus, the fixing belt 411 is rotated in the arrow R direction.

The pressure roller 42 is rotated at the same peripheral velocity as the fixing belt 411 by a driving force transmitted from a motor (not shown).

Medium Transport Device

As illustrated in FIG. 10, the medium transport device 50 includes the medium feeding portion 52, the medium discharge portion 54, the medium returning portion 56, and the intermediate transport portion 58.

Medium Feeding Portion

The medium feeding portion 52 includes containers 521 each containing a stack of sheet members P. In this exemplary embodiment, the containers 521 are disposed side-by-side in the width direction of the apparatus, below the transfer device 30.

Medium feeding paths 52P, each formed of multiple transportation roller pairs 522, guides (not shown), etc., are formed so as to extend from the corresponding container 521 to the transfer nip NT, where the second transfer is performed. The medium feeding paths 52P are turned back in the width direction of the apparatus at two turning portions 52P1 and 52P2 and extend upward to the transfer nip NT, thus forming a substantially S shape.

Above the containers 521 are provided feeding rollers 523 that feed top sheet members P in the containers 521. Among the transportation roller pairs 522, transportation roller pairs 522S, which are located on the most upstream side in the sheet-transport direction, function as separation rollers that separate the sheet members P fed in a stacked manner from the containers 521 by the feeding rollers 523 into individual sheets. Among the transportation roller pairs 522, a transportation roller pair 522R, which is located on the immediate upstream side of the transfer nip NT in the sheet-transport direction, is operated so as to match the timing at which a toner image on the transfer belt 31 is moved, and the timing at which a sheet member P is transported.

The medium feeding portion 52 also includes an auxiliary transportation path 52Pr. The auxiliary transportation path 52Pr starts from an opening 91W provided in the first housing 91, at an end opposite from the second housing 92, and is joined to the turning portion 52P2 of the medium feeding path 52P. The auxiliary transportation path 52Pr serves as a transportation path when a sheet member P fed from an optional recording-medium feeding device (not shown) disposed next to the opening 91W in the first housing 91 is sent to the image forming section 12.

Intermediate Transport Portion

As illustrated in FIG. 9, the intermediate transport portion 58 is disposed between the transfer nip NT of the transfer device 30 and the fixing nip NF of the fixing device 40 and includes multiple belt transportation members 581 each having an endless transportation belt wound around rollers.

The belt transportation members 581 transport a sheet member P with the rotating transportation belts while sucking air from the inside thereof (negative pressure suction), causing the sheet member P to stick to the surfaces of the transportation belts.

Medium Discharge Portion

As illustrated in FIG. 10, the medium discharge portion 54 discharges a sheet member P having a toner image fixed thereto by the fixing device 40 of the image forming section 12 to the outside of the housing 90 through a discharge port 92W, which is provided in the second housing 92, at the end opposite from the first housing 91.

The medium discharge portion 54 includes the discharged-medium receiving portion 541 for receiving the sheet member P discharged from the discharge port 92W.

This medium discharge portion 54 has a medium discharge path 54P, along which the sheet member P is transported from the fixing device 40 (fixing nip NF) to the discharge port 92W. The medium discharge path 54P includes a belt transportation member 543, multiple roller pairs 542, and a guide (not shown). Among the roller pairs 542, a roller pair 542E that is disposed on the most downstream side in the sheet-discharging direction functions as discharge rollers that discharge the sheet member P onto the discharged-medium receiving portion 541.

Medium Returning Portion

The medium returning portion 56 includes multiple roller pairs 561. These roller pairs 561 form a reversing path 56P, to which a sheet member P that has passed through the image inspection portion 66 is sent when double-sided printing is to be performed. The reversing path 56P includes a branch path 56P1, a transportation path 56P2, and a reversing path 56P3. The branch path 56P1 branches off from the medium discharge path 54P. The transportation path 56P2 feeds the sheet member P received from the branch path 56P1 to the medium feeding path 52P. The reversing path 56P3 is provided at an intermediate point of the transportation path 56P2 and reverses the direction in which the sheet is transported along the transportation path 56P2 (switch-back transportation) to reverse the front and back of the sheet member P.

Postprocessing Section

The medium cooling portion 62, the straightening device 64, and the image inspection portion 66, which constitute the postprocessing section 60, are arranged on the medium discharge path 54P of the medium discharge portion 54, on the upstream side of the branched portion of the branch path 56P1 in the sheet-discharging direction, in sequence from the upstream side in the discharge direction.

Medium Cooling Portion

The medium cooling portion 62 includes a heat absorbing device 621 that absorbs heat of the sheet member P, and a pressing device 622 that presses the sheet member P against the heat absorbing device 621. The heat absorbing device 621 is disposed above the medium discharge path 54P, and the pressing device 622 is disposed below the medium discharge path 54P.

The heat absorbing device 621 includes an endless heat-absorbing belt 6211, multiple rollers 6212 that support the heat-absorbing belt 6211, a heat sink 6213 disposed inside the heat-absorbing belt 6211, and a fan 6214 for cooling the heat sink 6213.

The heat-absorbing belt 6211 is in contact with the sheet member P at the outer circumferential surface thereof so as to enable heat exchange. Among the rollers 6212, a roller 6212D functions as a driving roller that transmits a driving force to the heat-absorbing belt 6211. The heat sink 6212 makes sliding contact with the inner circumferential surface of the heat-absorbing belt 6211 within a predetermined area along the medium discharge path 54P.

The pressing device 622 includes an endless pressing belt 6221 and multiple rollers 6222 that support the pressing belt 6221. The pressing belt 6221 is wound around the multiple rollers 6222. The pressing device 622 presses the sheet member P against the heat-absorbing belt 6211 (heat sink 6213) and transports the sheet member P in cooperation with the heat-absorbing belt 6211.

Straightening Device

The straightening device 64 is provided on the downstream side or the medium cooling portion 62 in the medium discharge portion 54. The straightening device 64 straightens the curled sheet member P received from the medium cooling portion 62.

Image Inspection Portion

An in-line sensor 661, which is a principal component of the image inspection portion 66, is disposed on the downstream side of the straightening device 64 in the medium discharge portion 54. The in-line sensor 661 detects the presence/absence and level of a toner density defect, an image defect, an image position defect, etc. of the fixed toner image on the basis of the light radiated to the sheet member P and reflected from the sheet member P.

Image Forming Operation of Image Forming Apparatus

Advantages

Next, an image forming process performed on a sheet member P by the image forming apparatus 10 and the outline of the subsequent postprocessing will be described.

As illustrated in FIG. 10, upon receipt of an image forming command, the controller 70 operates the toner-image forming portions 20, the transfer device 30, and the fixing device 40. As a result, as illustrated in FIG. 9, the photoconductor drums 21 of the image forming units 14 corresponding to the respective colors and the development roller 242 of the developing device 24 are rotated, and the transfer belt 31 is driven. Furthermore, the pressure roller 42 is rotated, and the fixing belt 411 is driven. In synchronization with these movements, the controller 70 activates the medium transport device 50 etc.

The photoconductor drums 21 corresponding to the respective colors are charged by the chargers 22 while being rotated. Furthermore, the controller 70 sends image data having undergone image processing in the image-signal processing unit to the respective exposure devices 23. The respective exposure devices 23 emit exposure light L according to the image data to the charged photoconductor drums 21. As a result, electrostatic latent images are formed on the surfaces of the photoconductor drums 21. The electrostatic latent images formed on the photoconductor drums 21 are developed by developer supplied from the developing devices 24. Thus, toner images in the first special color (V), in the second special color (W), in yellow (Y), in magenta (M), in cyan (C), and in black (K) are formed on the photoconductor drums 21 corresponding to the respective colors.

The toner images of the respective colors formed on the photoconductor drums 21 corresponding to the respective colors are sequentially transferred to the running transfer belt 31 by applying transfer voltages through the first transfer rollers 33 corresponding to the respective colors. As a result, a superposed toner image, in which six colors of toner images are superposed, is formed on the transfer belt 31. This superposed toner image is transported to the transfer nip NT by the running transfer belt 31.

As illustrated in FIG. 10, the sheet member P is fed to this transfer nip NT by the transportation roller pair 522R of the medium feeding portion 52, at the same time when the superposed toner image is transported. By applying a transfer voltage at the transfer nip NT, the superposed toner image is transferred from the transfer belt 31 to the sheet member P.

The sheet member P having the toner image transferred thereto is transported from the transfer nip NT of the transfer device 30 to the fixing nip NF of the fixing device 40 by the intermediate transport portion 58. The fixing device 40 applies heat and pressure to the sheet member P passing through the fixing nip NF. Thus, the toner image transferred to the sheet member P is fixed.

The sheet member P discharged from the fixing device 40 is transported by the medium discharge portion 54 to the discharged-medium receiving portion 541 outside the device, during which the sheet member P is treated by the postprocessing section 60. The sheet member P heated in the fixing process is first cooled by the medium cooling portion 62. Then, the curled sheet member P is straightened by the straightening device 64. Furthermore, the toner image fixed to the sheet member P is inspected for the presence/absence and level of a toner density defect, an image defect, an image position defect, etc. Then, the sheet member P is discharged to the medium discharge portion 54.

On the other hand, when an image is to be formed on a non-image surface of the sheet member P where no image is formed (i.e., when double-sided printing is to be performed), the controller 70 switches the transportation path for the sheet member P after passing through the image inspection portion 66 from the medium discharge path 54P of the medium discharge portion 54 to the branch path 56P1 of the medium returning portion 56. As a result, the sheet member P is allowed to pass through the reversing path 56P, where it is reversed, and is sent to the medium feeding path 52P. An image is formed on the back surface of the sheet member P and is fixed thereto through the same process as that performed on the front surface. This sheet member P goes through the same process as that performed on the front surface after an image is formed thereon and is discharged by the medium discharge portion 54 to the discharged-medium receiving portion 541 outside the device.

Configuration of Principal Part

Next, the control of the respective sections by the controller 70 when an image in black (K) is to be formed on a sheet member P will be described.

Figure 7:
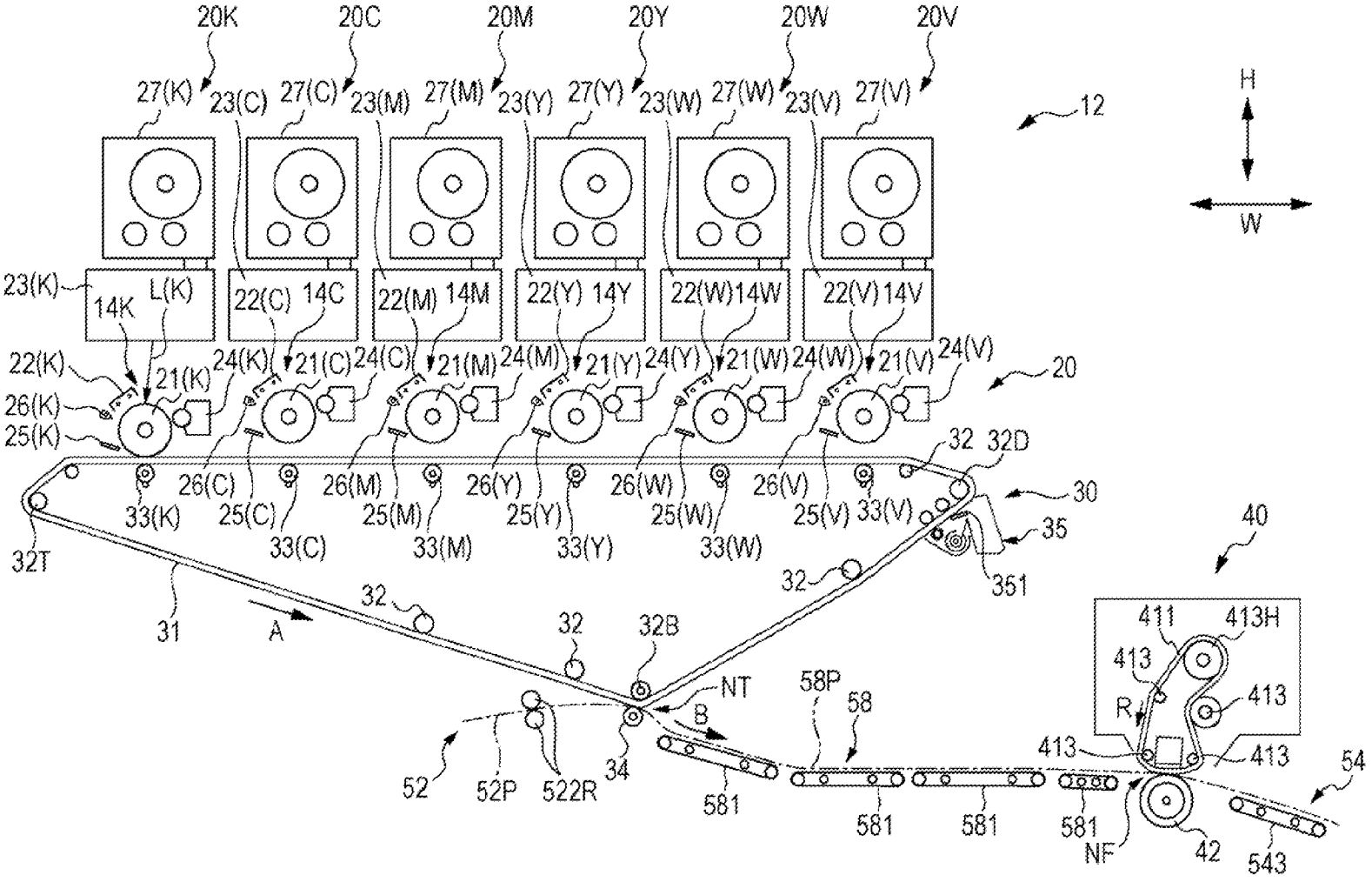
FIG. 7 is a diagram showing the configuration of image forming portions of the image forming apparatus according to the first exemplary embodiment of the present invention.

When an image in black (K) is to be formed on a sheet member P, the controller 70 retracts the photoconductor drums 21C to 21V provided in the toner-image forming portions 20C to 20V away from the transfer belt 31 using a retraction mechanism (not shown), as shown in FIG. 7.

Furthermore, the controller 70 differentiates between, in a transfer area of the transfer belt 31 to which a toner image is to be transferred by the first transfer roller 33K, a screen that is used to form a toner image to be transferred to this transfer area in a preceding print cycle and a screen that is used to form a toner image to be transferred to this transfer area in the subsequent print cycle.

A detailed description will be given below.

Figure 1:
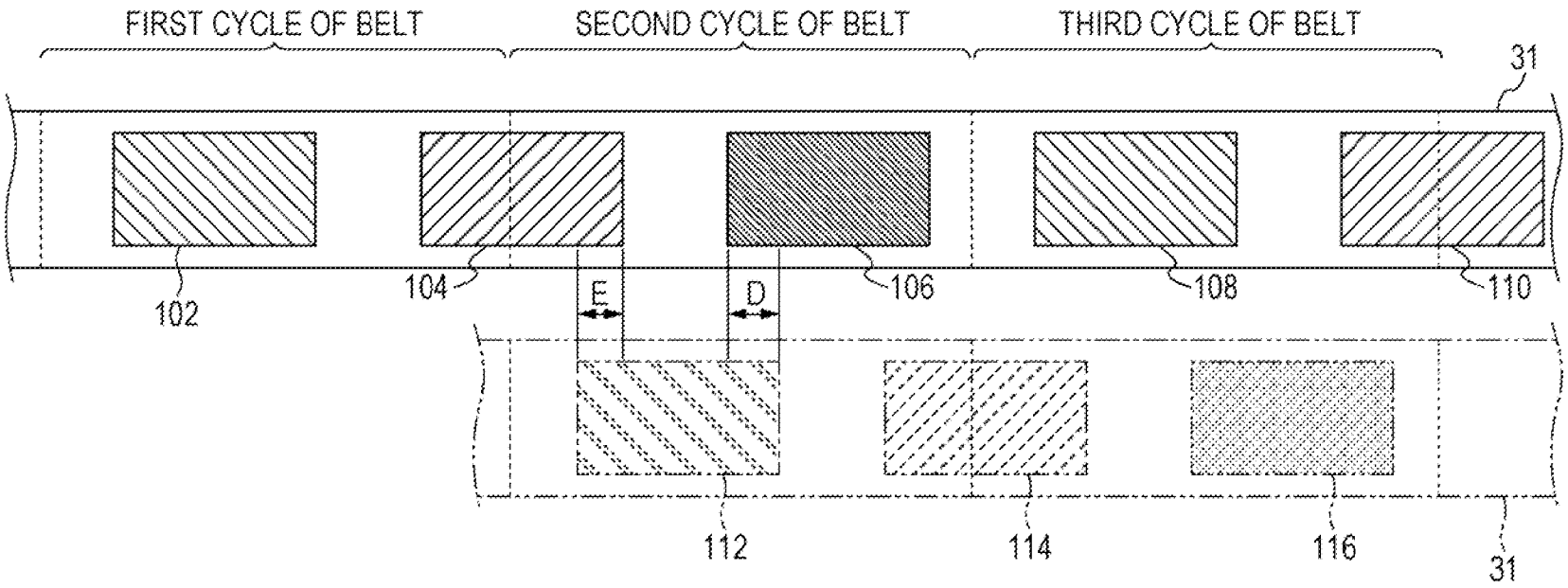
FIG. 1 is a schematic diagram showing toner images transferred, to a transfer belt used in an image forming apparatus according to a first exemplary embodiment of the present invention.

FIG. 1 shows, on the upper side, toner images 102, 104, 106, 108, and 110 transferred to the transfer belt 31 by the toner-image forming portion 20K and shows, on the lower side, the positions of transfer areas 112, 114, and 116, to which the toner images 102, 104, and 106 have been transferred, after the transfer belt 31 has been rotated. In this manner, FIG. 1 schematically shows the relationship between the transfer areas of the transfer belt 31 to which the toner images have been transferred in a preceding print cycle and toner images to be transferred to these transfer areas in the subsequent print cycle. The difference in the hatching pattern on the toner images shows the difference in screens used to form these toner images.

As shown in FIG. 1, the transfer area 112, to which the toner image 102 has been transferred in the first cycle of the transfer belt 31, partially overlaps the toner images 104 and 106 (areas E and D in FIG. 1) in the second cycle of the transfer belt 31.

In this situation, the controller 70 differentiates between the screen used to form the toner image 102 transferred to the transfer area 112 in the preceding print cycle and a screen that will be used to form the toner images 104 and 106 to be transferred to this transfer area 112 in the subsequent print cycle.

Screens are used when the image-signal processing unit 71 (see FIG. 10) of the controller 70 generates gradation data for controlling the exposure device 23 from image data received from an external device. The screens are, for example, dot grid patterns formed of multiple rows of dots. The controller 70 selects, from the dots forming a dot grid pattern, certain dots to be used to form dots each composed of multiple toner particles and then changes the size of the selected dots, thus forming gradation data.

Figure 5:
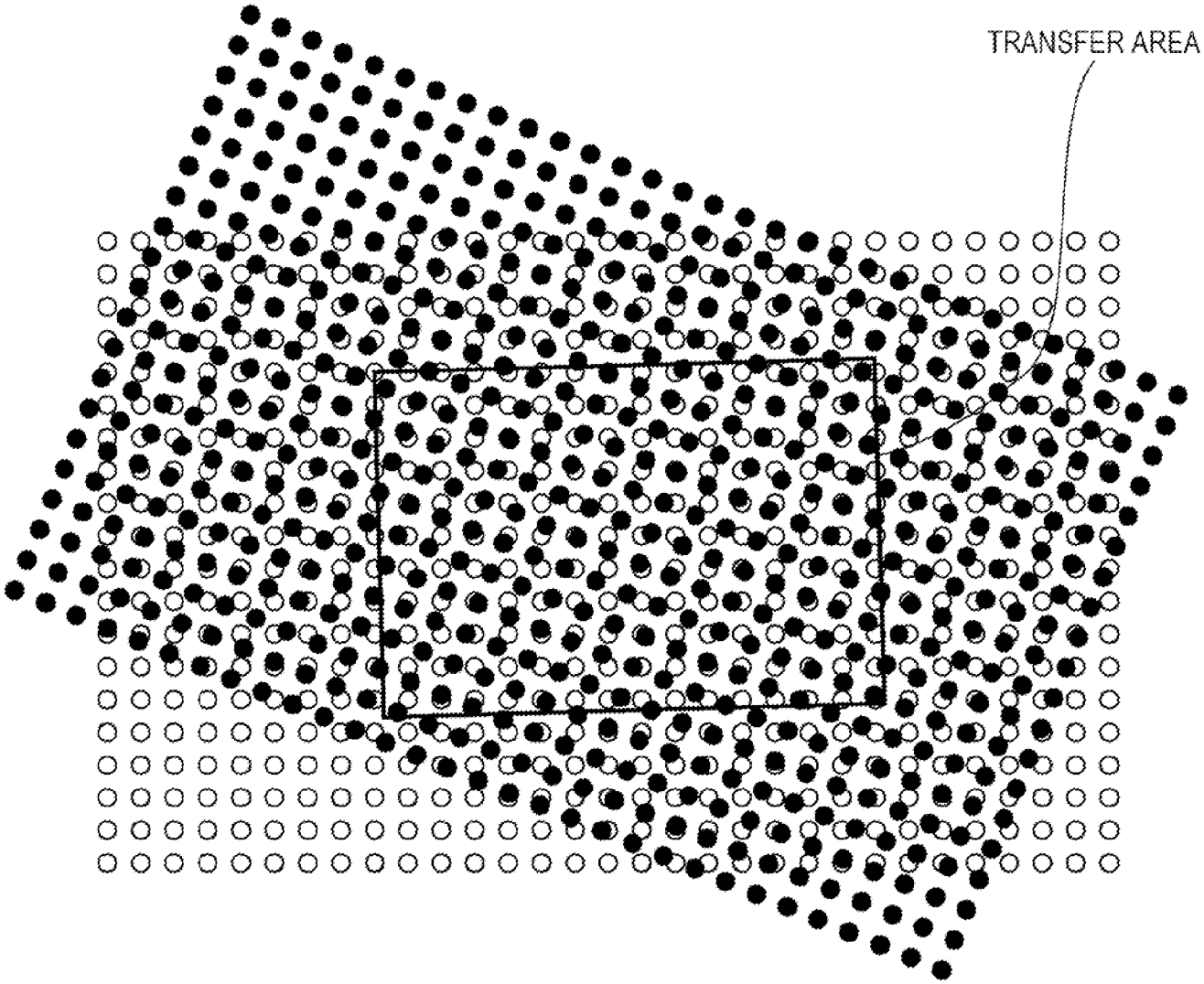
FIG. 5 is a schematic diagram showing a preceding screen and the subsequent screen that are used in the image forming apparatus according to the first exemplary embodiment of the present invention.

In this first exemplary embodiment, the controller 70 differentiates between a screen that is used to form a toner image to be transferred to a transfer area in a preceding print cycle and a screen that is used to form a toner image to be transferred to this transfer area in the subsequent print cycle by differentiating the angles of the screens, i.e., by differentiating the angles of rows of dots forming the screens (see FIG. 5).

Advantages of Principal Part Configuration

As has been described above, the controller 70 differentiates between a screen that is used to form a toner image to be transferred to a transfer area in a preceding print cycle and a screen that is used to form a toner image to be transferred to this transfer area in the subsequent print cycle by differentiating the angles of the screens.

The influence on a toner image when a screen that is used to form a toner image to be transferred to a transfer area in a preceding print cycle and a screen that is used to form a toner image to be transferred to this transfer area in the subsequent print cycle are the same will be described below, as a comparative example.

FIGS. 4A to 4D show the state of charge of the transfer belt 31.

Figure 4A:
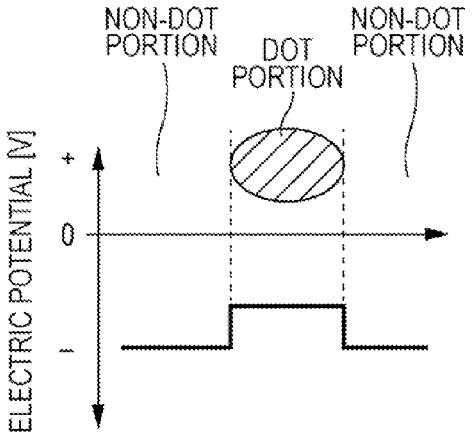
FIGS. 4A to 4D are schematic diagrams each showing the state of charge of the transfer belt of the image forming apparatus according to the first exemplary embodiment of the present invention.

First, the transfer belt 31 is negatively charged overall as a result of the first transfer by the first transfer roller 33K. As shown in FIG. 4A, the amount of charge in a dot portion (a portion where a dot is formed) is small, and the amount of charge in a non-dot portion (a portion where a dot is not formed) is large. That is, there is an electric potential difference between the dot portion and the non-dot portion.

Then, the transfer belt 31 is given a positive charge as a result of the second transfer by the second transfer roller 34. If a large amount of positive charge is given in the second transfer, the negative charge given in the first transfer is canceled, making the transfer belt 31 positively charged, whereas if a small amount of positive charge is given in the second transfer, the transfer belt 31 remains negatively charged.

Similarly to the first transfer, in the second transfer, the amount of charge in the dot portion is small and that in the non-dot portion is large. Hence, the electric potential of the dot portion and that of the non-dot portion after the second transfer depend on the level of the second transfer voltage.

Figure 4B:
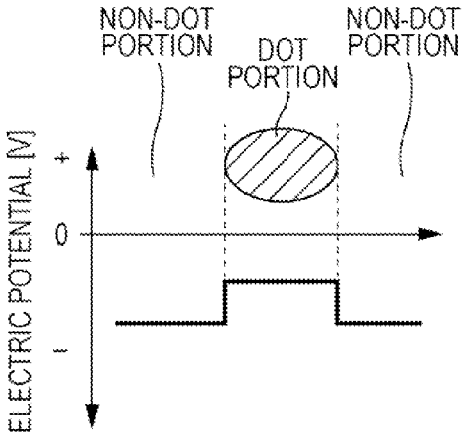

If the second transfer voltage is low, the relationship between the electric potential of the dot portion formed in the first transfer and that of the non-dot portion is unchanged and remains, in the form of a charging record, in the transfer belt 31, as shown in FIG. 4B.

Figure 4C:
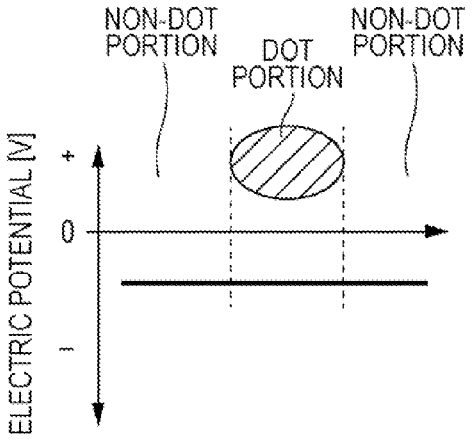
Figure 4D:
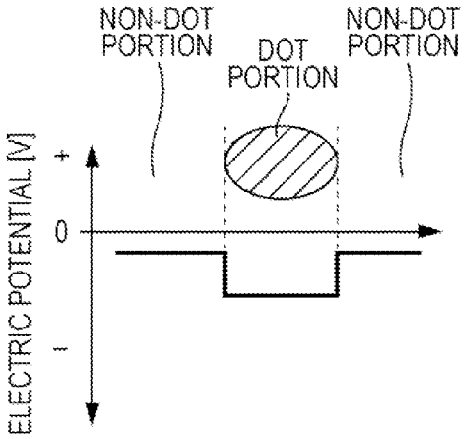

In contrast, if the second transfer voltage is high, the relationship between the electric potential of the dot portion formed in the first transfer and that of the non-dot portion is reversed and remains, in the form of a charging record, in the transfer belt 31, as shown in FIG. 4D. That is, the dot portion becomes relatively negative, and the non-dot portion becomes relatively positive.

On the other hand, if the second transfer voltage is neither low nor high, the electric potential of the dot portion and that of the non-dot portion become equal, as shown in FIG. 4C, and thus, no charging record is left.

Typically, the transfer voltage applied in the second transfer is high, as in the case shown in FIG. 4D.

If, in the first transfer, dots are formed on the transfer belt 31 having such a charging record as shown in FIG. 4D, dot defect or over-inhibition of dot defect occurs.

The dot defect and over-inhibition of dot defect will be described below.

As described above, when the second transfer voltage is high, the dot portion becomes relatively negative, and the non-dot portion becomes relatively positive (see FIG. 4D). There is an electric potential difference at the boundary between the dot portion and the non-dot portion, and negatively charged toner to be transferred to the transfer belt 31 receives the influence of an electric field generated by this electric potential difference.

Figure 3A:
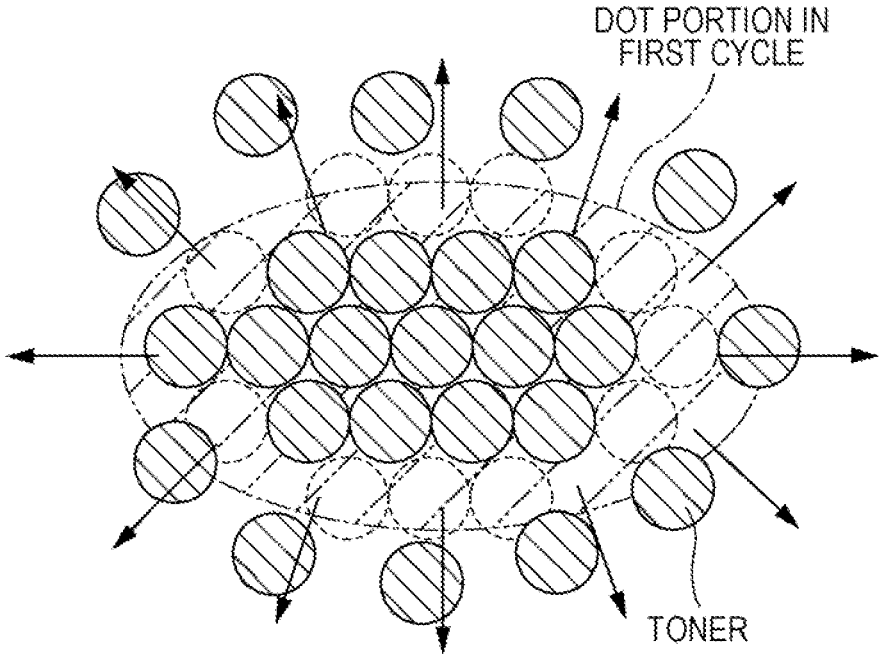
FIGS. 3A and 3B are schematic diagrams showing dots transferred to the transfer belt of the comparative-example image forming apparatus to be compared with the image forming apparatus according to the first exemplary embodiment of the present invention.

If, in the second cycle of the transfer belt 31, a dot is formed on the dot portion formed in the first cycle of the transfer belt 31, the toner particles forming the dot are subjected to forces directed to the outside of the dot (see arrows in FIG. 3) and move outward, as shown in FIG. 3A, resulting in dot defect.

Figure 3B:
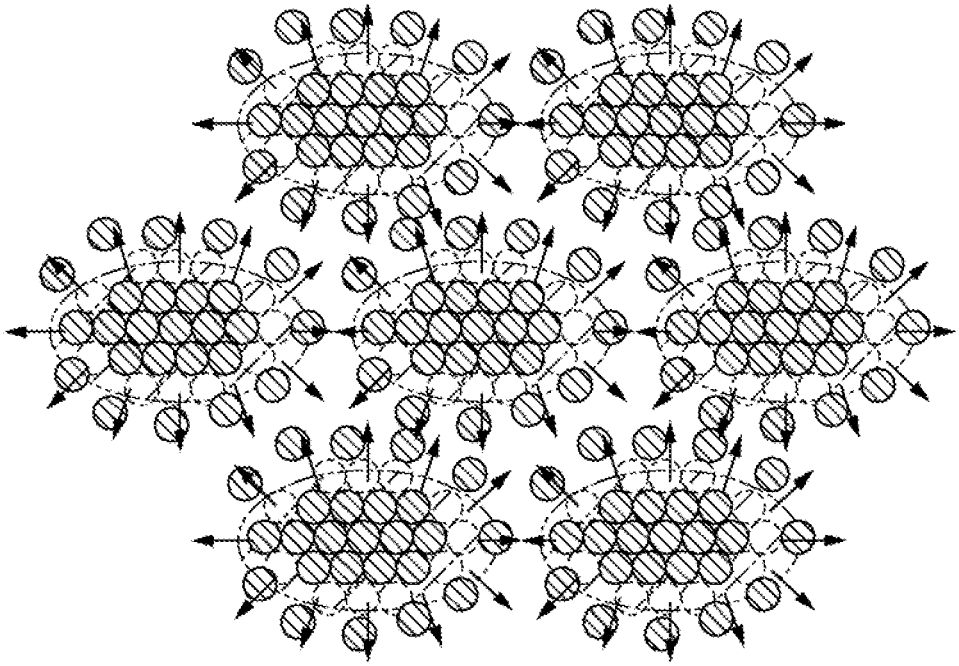

If the dot defect occurs in several adjacent dots, as shown in FIG. 3B, the distance between the toner particles forming adjacent dots becomes small, increasing the color intensity (the color becomes more intense).

Figure 2A:
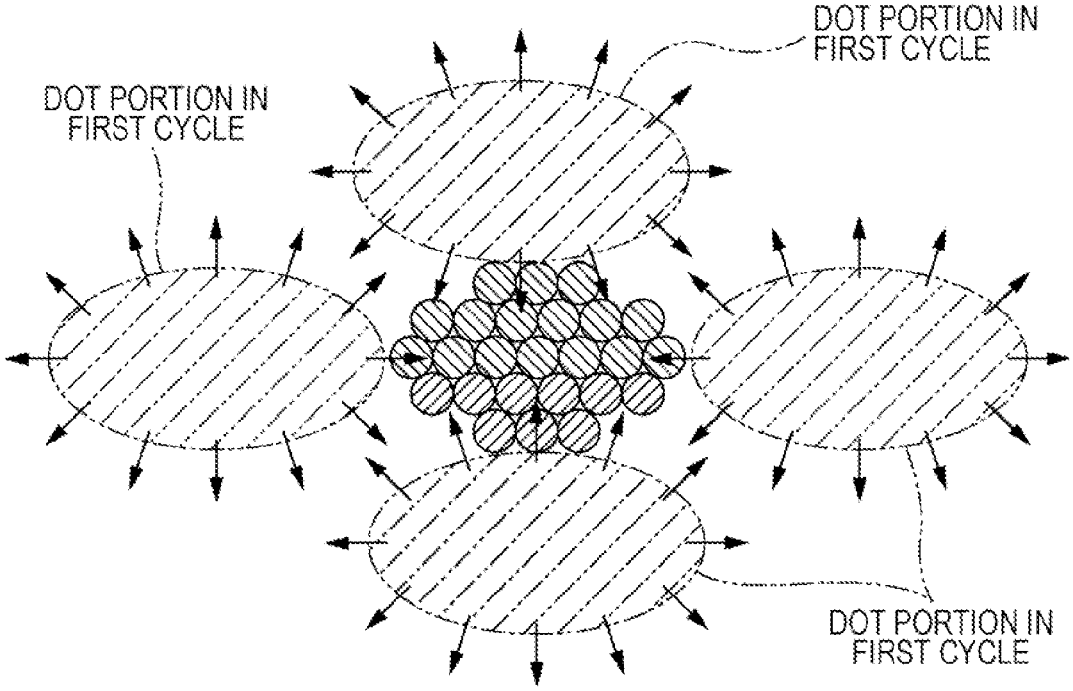
FIGS. 2A and 2B are schematic diagrams showing dots transferred to a transfer belt of a comparative-example image forming apparatus to be compared with the image forming apparatus according to the first exemplary embodiment of the present invention.

On the other hand, as shown in FIG. 2A, if, in the second cycle of the transfer belt 31, a dot is formed between dot portions (i.e., between a dot portion and a dot portion) formed in the first cycle of the transfer belt 31, the toner particles forming the dot are subjected to forces directed to the inner side of the dot (see arrows in FIG. 2A), resulting in over-inhibition of dot defect.

Figure 2B:
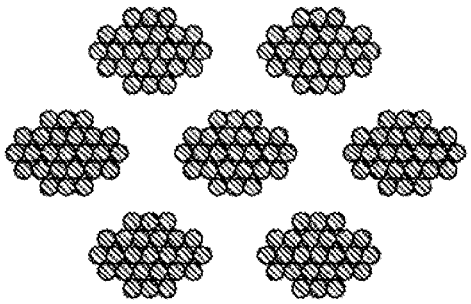

If this over-inhibition of dot defect occurs in several adjacent dots, the distance between the toner particles forming adjacent dots becomes large, as shown in FIG. 2B, decreasing the color intensity (the color becomes less intense).

In this manner, the charging record remaining in the transfer belt 31 causes the dot defect or the over-inhibition of dot defect, and, if it occurs in several adjacent dots, the color intensity varies. Note that, appropriate color intensity is achieved when there is no dot defect or over-inhibition of dot defect.

Such a phenomenon occurs especially when a screen that is used to forts a toner image to be transferred to a transfer area in a preceding print cycle and a screen that is used to form a toner image to be transferred to this transfer area in the subsequent print cycle are the same, as in the case of the comparative example. This is because the positions of the dots forming rows of dots on the screen in the first cycle and those in the second cycle are the same. Dots near a defective dot also become defective, and dots near a dot that is overly inhibited from being defective are also subjected to over-inhibition. That is, the dot defect occurs in a certain area, which increases the color intensity in that area. The over-inhibition of dot defect also occurs in a certain area, decreasing the color intensity in that area.

In this first exemplary embodiment, the controller 70 differentiates between a screen that is used to form a toner image to be transferred to a transfer area in a preceding print cycle and a screen that is used to form a toner image to be transferred to this transfer area in the subsequent print cycle by differentiating the angles of the screens.

In the above-described comparative example, the dot defect or the over-inhibition of dot defect occurs in a certain area, increasing or decreasing the color intensity.

However, by differentiating the angles of the screens, the dot defect or the over-inhibition of dot defect occurs only in a single dot or in a few adjacent dots, not in a certain area.

FIG. 5 shows a state in which the angles of the screens are differentiated. By changing the angle of a screen formed of rows of outlined dots (○) (corresponding to the charging record produced in the first cycle of the transfer belt), a screen formed of rows of filled-in dots (•) (corresponding to toner dots formed in the second cycle of the transfer belt) is obtained. In this manner, by differentiating the angles of the screens, the positions of the filled-in dots relative to the positions of the outlined dots constantly vary, and, portions where the outlined dots overlap the filled-in dots and portions where the outlined dots do not overlap the filled-in dots appear alternately.

With this configuration, although the dot defect or the over-inhibition of dot defect occurs in each dot, because such dots appear alternately, the variation in color intensity is suppressed as a whole.

Figure 6:
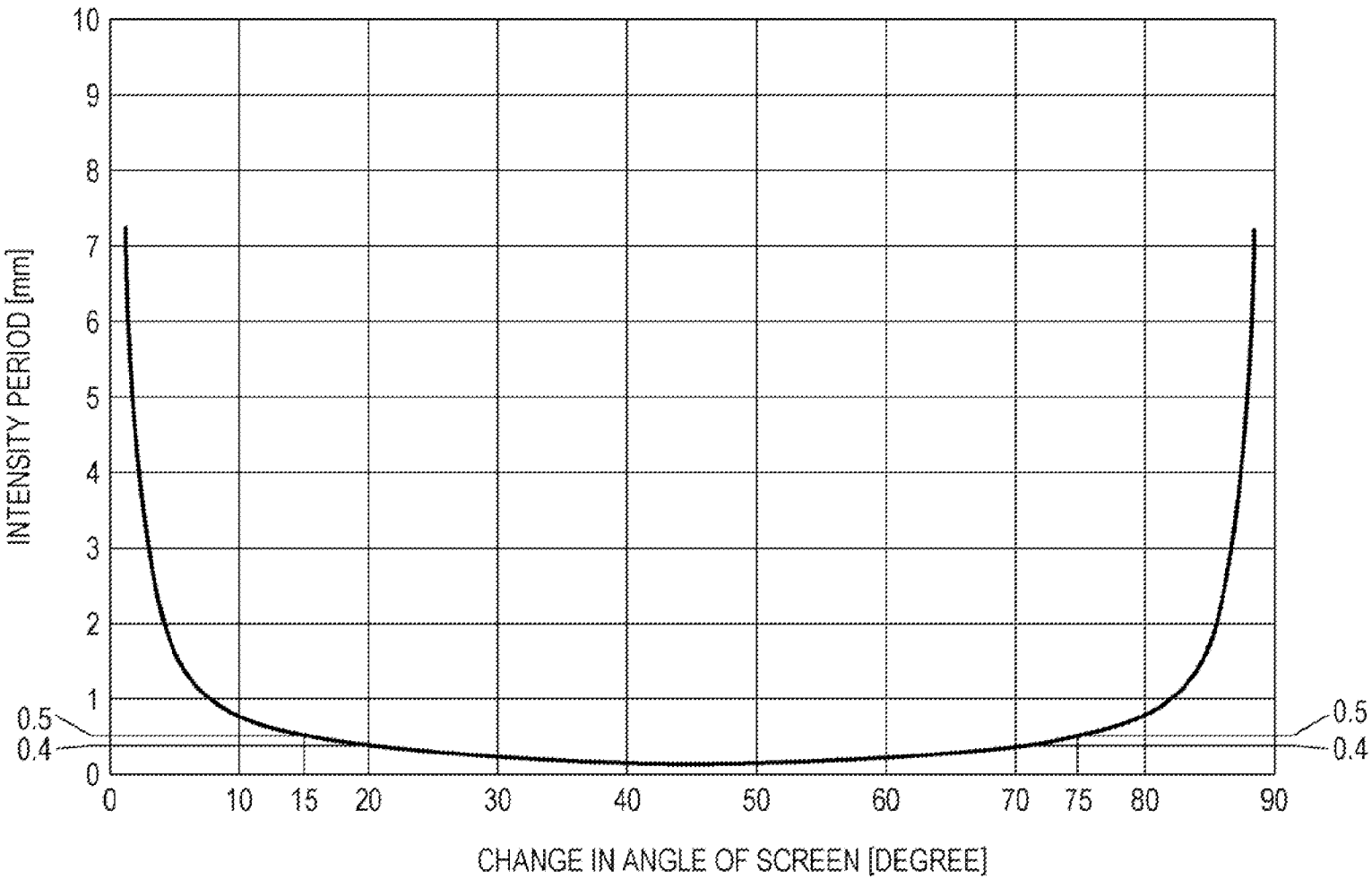
FIG. 6 is a graph showing the effect of the image forming apparatus according to the first exemplary embodiment of the present invention.

FIG. 6 is a graph showing an intensity period obtained when the angle of a screen with a density of 200 dpi (dot per inch) in the transportation direction is changed. Furthermore, it is assumed that the transfer belt 31 has a high volume resistivity (1011 Ωcm or more). More specifically, the vertical axis indicates the color intensity period [mm] produced by the dot defect and the over-inhibition of dot defect, and the horizontal axis indicates a change in angle of the screen [degrees]. The intensity period appears in the form of an interference pattern between the rows of the outlined dots (the charging record left by the screen used in the first cycle) and the rows of the filled-in dots (the toner dots formed using the screen in the second cycle). Hence, the intensity period may be calculated, and FIG. 6 shows the calculation result.

In a black halftone image, in which the difference in intensity is most clearly observed, when the intensity period is 0.5 [mm] or less, the difference in intensity is less visible, and when the intensity period is 0.4 [mm] or less, the difference in intensity is even less visible.

As is obvious from this graph, when a change in angle of the screen is in the range from 15 to 75 degrees, the intensity period is 0.5 [mm] or less, and when a change in angle of the screen is in the range from 20 to 70 degrees, the intensity period is 0.4 [mm] or less. Thus, to suppress the variation in color intensity, a change in angle of the screen should be in the range from 15 to 75 degrees, and more desirably, it should be in the range from 20 to 70 degrees.

Summary

The controller 70 differentiates between a screen that is used to form a toner image to be transferred to a transfer area in a preceding print cycle and a screen that is used to form a toner image to be transferred to this transfer area in the subsequent print cycle by differentiating the angles of the screens. Thus, as is obvious from the graph in FIG. 6, the variation in color intensity due to the charging record remaining in the transfer belt 31 is suppressed.

Second Exemplary Embodiment

Next, an example of an image forming apparatus according to a second exemplary embodiment of the present invention will be described with reference to FIG. 11. The same components as those in the first exemplary embodiment will be denoted by the same reference numerals, and the description thereof will be omitted. The difference from the first exemplary embodiment will be discussed.

The controller 70 according to the second exemplary embodiment differentiates between a screen that is used to form a toner image to be transferred to a transfer area in a preceding print cycle and a screen that is used to form a toner image to be transferred to this transfer area in the subsequent print cycle by differentiating the densities of dots (dot densities) of the screens.

Figure 11:
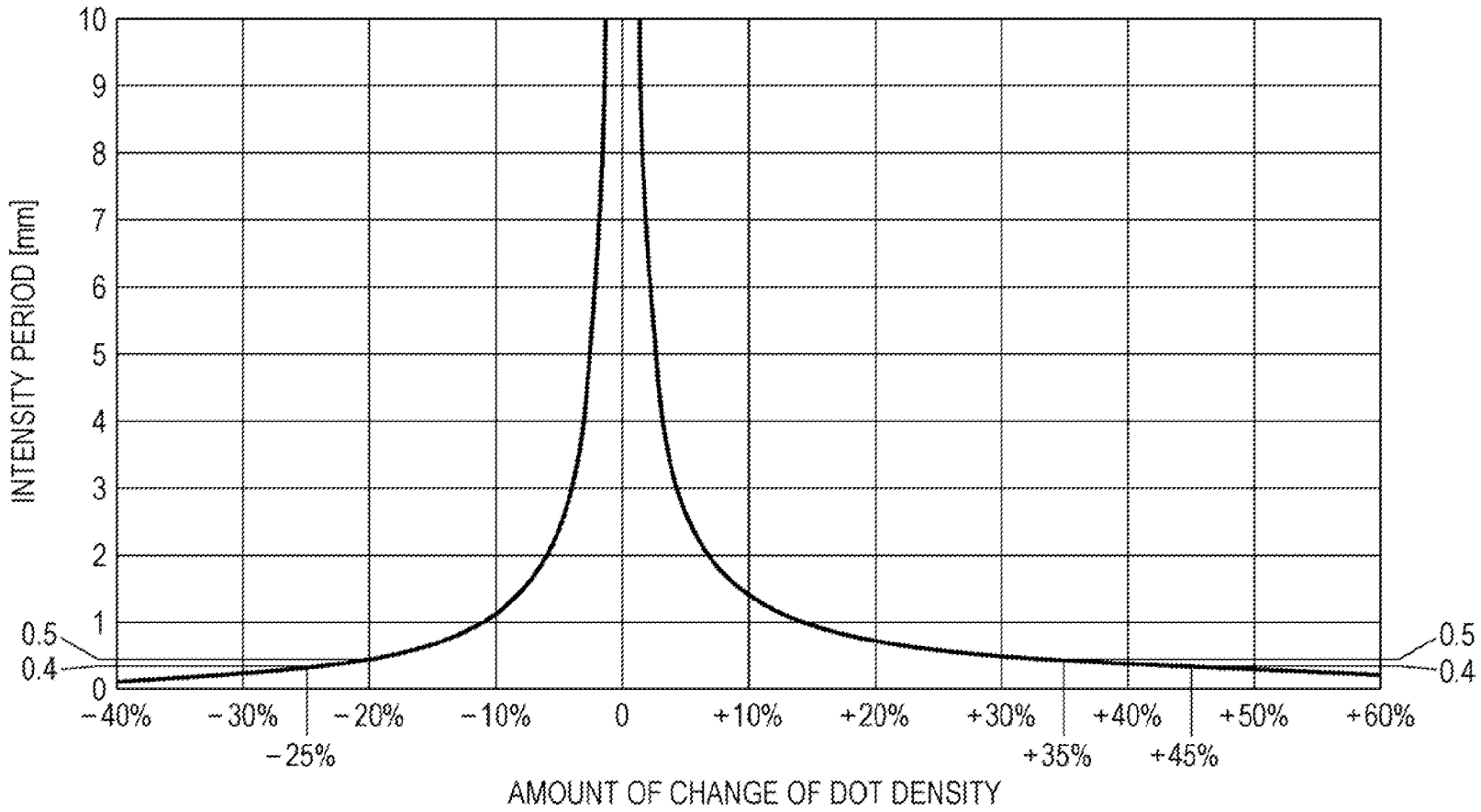
FIG. 11 is a graph showing the effect of an image forming apparatus according to a second exemplary embodiment of the present invention.

FIG. 11 is a graph showing an intensity period obtained when the dot density is changed. Furthermore, it is assumed that the transfer belt 31 has a high volume resistivity (1011 Ωcm or more). More specifically, the vertical axis indicates the color intensity period [mm], and the horizontal axis indicates the amount of change in dot density when a density of 200 [dpi] in the transportation direction is assumed to be 0. For example, an amount of change in dot density of −10% corresponds to a change in dot density from 200 [dpi] to 180 [dpi], and an amount of change in dot density of +10% corresponds to a change in dot density from 200 [dpi] to 220 [dpi].

As is obvious from this graph, when the amount of change in dot density is −20% (160 [dpi]) or less or +35% (270 [dpi] or more, the intensity period is 0.5 [mm] or less, and when the amount of change in dot density is −25% (150 [dpi]) or less or +45% (230 [dpi]) or more, the intensity period is 0.4 [mm] or less. Thus, to suppress the variation in color intensity, the amount of change in dot density should be −20% or less or +35% or more, and more desirably, it should be −25% or less or +45% or more.

Summary

The controller 70 differentiates between a screen that is used to form a toner image to be transferred to a transfer area in a preceding print cycle and a screen that is used to form a toner image to be transferred to this transfer area in the subsequent print cycle by differentiating the densities of dots of the screens. Thus, as is obvious from the graph in FIG. 11, the variation in color intensity due to the charging record remaining in the transfer belt 31 is suppressed.

Third Exemplary Embodiment

Next, an example of an image forming apparatus according to a third exemplary embodiment of the present invention will be described below. The same components as those in the first exemplary embodiment will be denoted by the same reference numerals, and the description thereof will be omitted. The difference from the first exemplary embodiment will be discussed.

In the third exemplary embodiment, the controller 70 operates the toner-image forming portions 20K to 20V, bringing the photoconductor drums 21 corresponding to all the colors into contact with the transfer belt 31, and transfers color toner images to a sheet member P (see FIG. 9).

The controller 70 differentiates between a screen that is used to form toner images transferred to a transfer area of the transfer belt 31 with the toner-image forming portions 20K to 20V in a preceding print cycle (first cycle) and a screen that is used to form a toner image to be transferred to this transfer area by the toner-image forming portion 20V, which is disposed on the most upstream side, in the rotation direction of the transfer belt 31, among the toner-image forming portions that are used to transfer toner images in the subsequent print cycle (second cycle).

With this configuration, the variation in color intensity in the toner image transferred to the transfer belt 31 by the toner-image forming portion 20V is suppressed.

Note that, regarding the toner images to be transferred to the transfer belt 31 by the toner-image forming portions 20K to 20W, because a portion of the transfer belt 31 to which the toner images will be transferred by the toner-image forming portions 20K to 20W has passed through the toner-image forming portion 20V disposed on the upstream side thereof, in the rotation direction of the transfer belt 31, when the toner images are to be transferred to the transfer belt 31 by the toner-image forming portions 20K to 20W, the charging record in this portion of the transfer belt 31 has been changed. Thus, change of a screen that is used to form toner images with the toner-image forming portions 20K to 20W would have little influence on the variation in the intensity.

Fourth Exemplary Embodiment

Next, an example of an image forming apparatus according to a fourth exemplary embodiment of the present invention will be described with reference to FIG. 12, The same components as those in the third exemplary embodiment will be denoted by the same reference numerals, and the description thereof will be omitted. The difference from the first exemplary embodiment will be discussed.

In the fourth exemplary embodiment, screens that are used to form toner images with the toner-image forming portions 20K to 20W are not specifically limited. Typically, the screens for the toner-image forming portions 20K to 20Y are ail different, and the screens for the toner-image forming portions 20V and 20W are selected depending on the colors they use.

Figure 12:
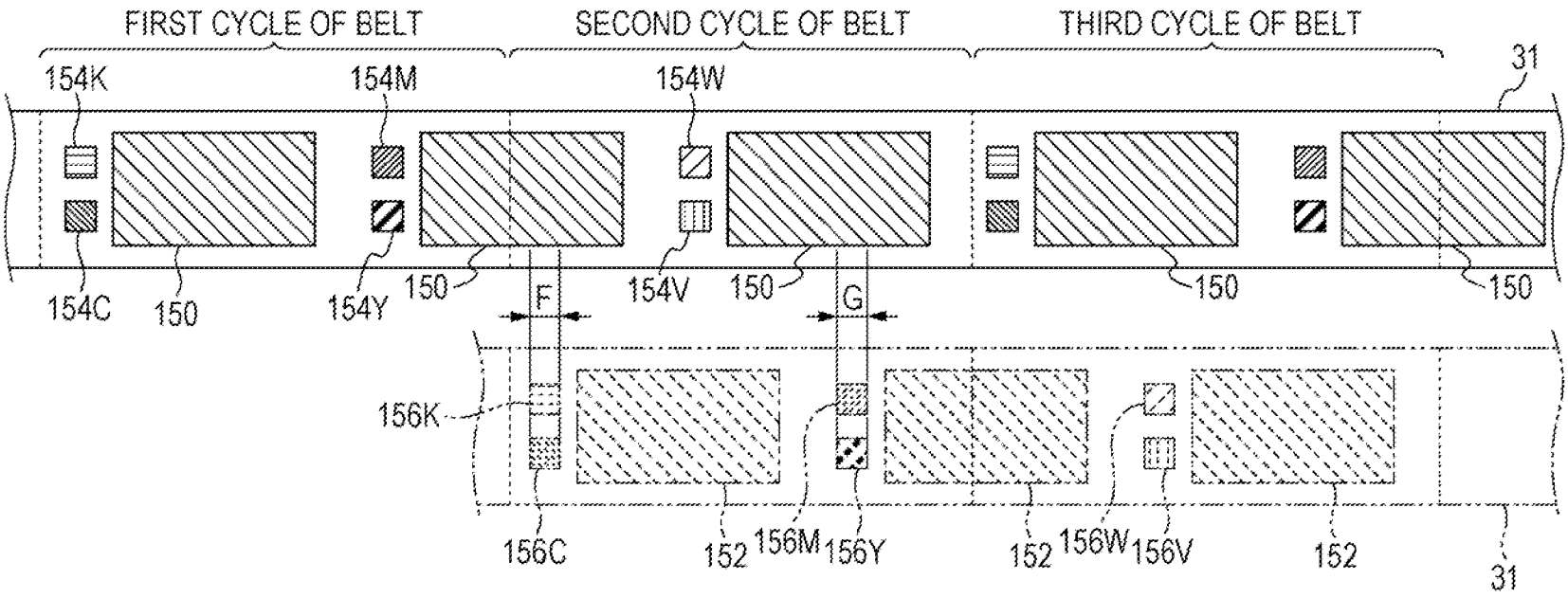
FIG. 12 is a schematic diagram showing toner images and toner patches transferred to a transfer belt used in an image forming apparatus according to a fourth exemplary embodiment of the present invention.

FIG. 12 shows, on the upper side, multiple toner images 150 (an example of a first toner image) transferred to the transfer belt 31 by the toner-image forming portions 20 and toner patches 154K to 154V (an example of a second toner image) transferred to the transfer belt 31 and shows, on the lower side, the positions of transfer areas 152, to which the toner images 150 have been transferred, and transfer areas 156K to 156V, to which the toner patches 154K to 154V have been transferred, after the transfer belt 31 has been rotated. In this manner, FIG. 12 schematically shows the relationship between the transfer areas of the transfer belt 31 to which the toner images and toner patches have been transferred in a preceding print cycle and the toner images and the toner patches to be transferred to these transfer areas in the subsequent print cycle. The difference in the hatching pattern shows the difference in screens used to form the toner patches.

The toner patches 154 will be described below. The toner-image forming portions 20K to 20V of the respective colors form the toner patches 154K to 154V of the respective colors that are used to adjust the toner intensity. These toner patches 154K to 154V are transferred to areas between the toner images 150 (inter images) on the transfer belt 31. More specifically, two toner patches 154 of different colors are transferred side-by-side in the direction perpendicular to the transportation direction of the transfer belt 31.

The controller 70 differentiates between a screen that is used to form toner images with the toner-image forming portion 20V, which is disposed on the most upstream side in the rotation direction of the transfer belt 31, and screens that are used to form the toner patches 154 of the respective colors with the toner-image forming portions 20K to 20V. In this exemplary embodiment, the screens that are used to form the toner patches 154 of the respective colors are also differentiated from one another.

With this configuration, even when the transfer areas 156, i.e., the areas where the toner patches 154 have been transferred to the transfer belt 31 in the first cycle of the transfer belt 31, partially overlap (e.g., areas F and G) the toner images 150 in the second cycle of the transfer belt 31, as shown in FIG. 12, the variation in color intensity of the toner images 150 is suppressed.

Summary

The controller 70 differentiates between a screen that is used to form toner images with the toner-image forming portion 20V and screens that are used to form the toner patches 154 of the respective colors with the toner-image forming portions 20K to 20V. By doing so, even when the screens used to form toner images cannot be differentiated, the variation in color intensity due to the charging record remaining in the transfer belt 31 is suppressed in the areas F and G in FIG. 12.

Although the present invention has been described in detail based on the specific exemplary embodiments, the present invention is not limited to such exemplary embodiments, and it would be obvious for those skilled in the art that various other exemplary embodiments are possible within the scope or the present invention. For example, although not specifically described in the above-described exemplary embodiments, because discharge at the second transfer nip NT is effectively suppressed by using a transfer belt 31 having high volume resistivity (1011 Ωcm or more), an image defect, such as a white spot, due to the discharge is prevented.

Furthermore, although a method of differentiating between screens is not mentioned in the above-described third exemplary embodiment, the screens may be differentiated by differentiating the angles of the screens or the densities of dots of the screens.

Furthermore, although it has not been specifically described in the above-described exemplary embodiments, the effect of suppressing the variation in color intensity is particularly evident when halftone images with middle to low intensity are output.

In addition, although multiple toner-image forming portions 20 are operated in the above-described fourth exemplary embodiment, when only one of the toner-image forming portions 20 is operated (i.e., in the single-color mode), a screen that is used to form a toner image with the operated toner-image forming portion 20 is differentiated from a screen that is used to form a toner patch.

Furthermore, in the first exemplary embodiment, although screens are formed of multiple rows of dots, the screens may be formed of multiple rows of lines. In such a case, by differentiating the angles of rows of lines forming the screens, a screen that is used to form a toner image to be transferred to a transfer area in a preceding print cycle is differentiated from a screen that is used to form a toner image to be transferred to this transfer area in the subsequent print cycle.

In addition, in the second exemplary embodiment, although a screen that is used to form a toner image to be transferred to a transfer area in a preceding print cycle is differentiated from a screen that is used to form a toner image to be transferred to this transfer area in the subsequent print cycle by differentiating the densities of dots (dot densities) of the screens, when the screens are formed of multiple rows of lines, the densities of lines (the area occupied by the lines per unit area) of the screens may be differentiated.

Furthermore, in the fourth exemplary embodiment, although the toner patches are described as being used to adjust the toner intensity, the toner patches may alternatively be used to stabilize the operation of photoconductor cleaners or a transfer belt cleaner (not shown), to maintain the developer in the developing unit in good condition, or to align the positions of toner images of the respective colors.

In addition, in the above-described exemplary embodiments, although the tandem image forming apparatus 10 has been described as an example, the configuration of the present invention may be used in a rotary image forming apparatus. Also in the case or a rotary image forming apparatus, a screen used to form a toner image to be transferred to a transfer area of the transfer belt in a preceding print cycle is differentiated from a screen that is used to form a toner image to be transferred to this transfer area for the first time after the transfer belt has been rotated and the toner image has been second-transferred to a sheet member P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming portion that forms a toner image using a screen;

a first transfer member that transfers the toner image formed by the image forming portion to a rotating transfer belt;

a second transfer member that transfers the toner image transferred to the transfer belt by the first transfer member to a recording medium; and a controller that differentiates between, in a first transfer area of the transfer belt to which the toner image is transferred by the first transfer member, a first screen that is used to form a toner image to be transferred to the first transfer area in a first print cycle and a second screen that is used to form a toner image to be transferred to the first transfer area for the first time after the transfer belt has been rotated, after the first print cycle, and after the toner image to be transferred to the first transfer area in a first print cycle has been second-transferred to a recording medium.

2. The image forming apparatus according to claim 1, wherein the controller differentiates between the screens by differentiating the angles of rows of dots or rows of lines forming the screens.

3. The image forming apparatus according to claim 2, wherein a plurality of image forming portions are provided corresponding to the respective colors, the plurality of image forming portions being arranged in a line in the rotation direction of the transfer belt, and the controller differentiates between, in the transfer area of the transfer belt to which toner images formed by the image forming portions are transferred by the first transfer member, a screen that is used to form toner images to be transferred to the transfer area in a preceding print cycle and a screen that is used to form a toner image to be transferred to this transfer area by the image forming portion that is disposed on a most upstream side, in the rotation direction of the transfer belt, among the image forming portions used to transfer toner images in the subsequent print cycle after the transfer belt has been rotated.

4. The image forming apparatus according to claim 1, wherein the controller differentiates between the screens by differentiating the densities of dots or lines forming the screens.

5. The image forming apparatus according to claim 4, wherein a plurality of image forming portions are provided corresponding to the respective colors, the plurality of image forming portions being arranged in a line in the rotation direction of the transfer belt, and the controller differentiates between, in the transfer area of the transfer belt to which toner images formed by the image forming portions are transferred by the first transfer member, a screen that is used to form toner images to be transferred to the transfer area in a preceding print cycle and a screen that is used to form a toner image to be transferred to this transfer area by the image forming portion that is disposed on a most upstream side, in the rotation direction of the transfer belt, among the image forming portions used to transfer toner images in the subsequent print cycle after the transfer belt has been rotated.

6. The image forming apparatus according to claim 1, wherein a plurality of image forming portions are provided corresponding to the respective colors, the plurality of image forming portions being arranged in a line in the rotation direction of the transfer belt, and the controller differentiates between, in the transfer area of the transfer belt to which toner images formed by the image forming portions are transferred by the first transfer member, a screen that is used to form toner images to be transferred to the transfer area in a preceding print cycle and a screen that is used to form a toner image to be transferred to this transfer area by the image forming portion that is disposed on a most upstream side, in the rotation direction of the transfer belt, among the image forming portions used to transfer toner images in the subsequent print cycle after the transfer belt has been rotated.

7. The image forming apparatus according to claim 1, wherein the controller differentiates between the screens by changing the angles of the screens or the densities of dots of the screens.

8. An image forming apparatus comprising:

an image forming portion that forms, using a first screen, a plurality of first toner images to be transferred to recording media in a first print cycle, and that forms, using a second screen, a second toner image to be used for a purpose other than being transferred to the recording media, the second toner image being formed between the first toner images;

a first transfer member that transfers the first toner images and second toner image formed by the image forming portion to a rotating transfer belt;

a second transfer member that transfers the first toner images transferred to the transfer belt by the first transfer member to the recording media after the first print cycle; and a controller that differentiates between, in a first transfer area of the transfer belt to which the first toner image is transferred by the first transfer member, the first screen used to form the first toner images and the second screen that is used to form the second toner image.

9. An image forming apparatus comprising:

a plurality of image forming portions provided corresponding to the respective colors and arranged in a line in the rotation direction of a rotating transfer belt, the image forming portions forming, using screens, a plurality of first toner images to be transferred to recording media in a first print cycle, and forming, using screens, second toner images to be used for a purpose other than being transferred to the recording media, the second toner images being formed between the first toner images;

first transfer members that transfer the first toner images and second toner images formed by the image forming portions to the transfer belt;

a second transfer member that transfers the first toner images transferred to the transfer belt by the first transfer members to the recording media after the first print cycle; and a controller that differentiates between, in a first transfer area of the transfer belt to which the toner image is transferred by the first transfer member, a first screen that is used to form the first toner image with the image forming portion that is disposed on a most upstream side, in the rotation direction of the transfer belt, among the image forming portions used to transfer toner images and other screens that are used to form the second toner images with the plurality of image forming portions.

* * * * *